United States Patent [19]

Sugiyama et al.

[11] 4,113,489

[45] Sep. 12, 1978

[54] METHOD OF FORMING PHOTOGRAPHIC LINE AND HALF-TONE IMAGES

[75] Inventors: Mitsunori Sugiyama; Shoji Ishiguro; Nobuo Sugiyama; Yoo Iijima; Eiichi Okutsu; Haruhiko Iwano, all of Minami-ashigara; Katsumi Hosoya; Hikoharu Hara, both of Odawara, all of Japan

[73] Assignee: Fuji Photo Film Co., Ltd., Minami-ashigara, Japan

[21] Appl. No.: 231,001

[22] Filed: Mar. 1, 1972

[51] Int. Cl.[2] ..... G03C 5/32; G03C 5/38

[52] U.S. Cl. ..... 96/60 R; 96/61 R

[58] Field of Search ..... 96/63, 66, 60, 61, 29 L, 96/33

[56] References Cited

U.S. PATENT DOCUMENTS

| | | | |
|---|---|---|---|
| 1,814,788 | 7/1931 | Tartas | 96/59 |
| 2,178,896 | 11/1939 | Pifer | 96/59 |
| 3,178,282 | 4/1965 | Luckey et al. | 96/64 |
| 3,671,246 | 6/1972 | Corben | 96/63 |
| 3,762,923 | 10/1973 | Sugiyama et al. | 96/63 |

*Primary Examiner*—Mary F. Kelley

*Attorney, Agent, or Firm*—Sughrue, Rothwell, Mion, Zinn and Macpeak

[57] ABSTRACT

High-contrast photographic images are obtained by developing with a developer containing at least one dihydroxybenzene and sulfite ion and then treating with a solution of an oxidizing agent.

18 Claims, No Drawings

METHOD OF FORMING PHOTOGRAPHIC LINE AND HALF-TONE IMAGES

This invention relates to a method of forming photographic line and half-tone images for the graphic arts and more particularly, it is concerned with a new method of forming dot-images having excellent dot qualities for printing patterns by introducing an oxidizing bath into a series of processings for forming dot-images in the graphic arts.

In the graphic arts field, where it is desired to make photographic line and half-tone reproductions, it is customary to use a high contrast silver halide photographic element which is called a lithographic film or lithographic plate. It is desired that dot-images are composed of spots having a maximum density and background having a minimum density, but even a high-contrast photographic element forms a region of intermediate density called "fringe" around dots when it is exposed and developed. The fringe, lowering the quality of the printing pattern, is undesirable in photographic line and half-tone reproductions. That is, the less the fringe, the better the quality of the dots.

A developer for a high-contrast photographic element such as lith film or lith plate is ordinarily an alkaline developer containing hydroquinone as a developing agent and aldehydealkali metal hydrogen sulfite adduct, ascorbic acid or acetone-soluble sulfite adduct as preservatives. Since such a developer contains a low concentration of free sulfite ion, hydroquinone is not inactivated owing to the formation of hydroquinonemonosulfonic acid which is rather a compound having a higher activity than hydroquinone resulting in a rapid and strong development. However, even when the so-called lith development is carried out complete elimination of fringes around dots is impossible. For this purpose, it has been proposed that a developed and fixed photographic element be treated with Farmer's reducer. This method, which is called a dot-etching method, makes it possible to remove fringes around dots, but, on the contrary, meets with some disadvantages. Since the Farmer's reducer is composed of ferricyanide and thiosulfate, it is very unstable and loses its capacity after short periods of time, because ferricyanide is converted into ferrocyanide and because thiosulfate decomposes in a short time. And the time necessary for moving fringes therewith is not constant, so the operation must be carefully carried out by the skilled operator. The operation needs longer time.

An object of this invention to provide a method for processing a high contrast photographic element. Another object of the invention is to provide a method for forming improved quality of dot-images for the graphic arts. Still another object of the invention is to provide a simple and rapid method for removing fringes around dot-images.

We the inventors have now found that the above objects can be accomplished by processing a high-contrast photographic element with an oxidizing agent at a step after development and till fixation. Such step may be one between the development and the fixation or may be the fixation. In the invention, the oxidizing agent must partially oxidize a developed silver image but may not completely oxidize the silver image. In other words, when the developed photographic element is oxidized with the oxidizing agent, the developed silver forming dots are maintained in the photographic layer without being completely converted into silver halide.

Such oxidizing agent contains bichromates such as potassium bichromate or sodium bichromate, ferricyanides such as potassium ferricyanide or sodium ferricyanide, persulfates such as sodium persulfate or ammonium persulfate, perchlorates such as potassium perchlorate or sodium perchlorate, and complex salts of ferric ion with an organic acid such as ferric ethylene diamine tetraacetic acid or sodium ferric ethylene diamine tetraacetic acid.

The above oxidizing agents are further classified into two groups by the oxidizing power thereof though they do not completely oxidize the developed silver. One group which has comparatively stronger oxidizing power contains bichromates, ferricyanides, persulfates, perchlorates and water soluble salts thereof such as an alkali metal salt or ammonium salt. The other group which has weaker oxidizing power than that of the one group contains complex salts of ferric ion with an organic acid.

The former oxidizing agent having comparatively stronger oxidizing power is advantageously used in a step between the development and the fixation. That is, an exposed high contrast photographic element, after development, is processed in a short time with an aqueous solution of the former oxidizing agent and then fixed. The solution of oxidizing agent has surprisingly a strong effect of removing fringes though it does not contain a silver halide dissolving agent and is not unstable like Farmer's reducer. Accordingly, according to the process, dot-images can be stably made under uniform conditions for a long period.

The other oxidizing agent which is the complex salt is advantageously used in the fixation, because the fixing solution is stable even if the complex salts and the fixing agent such as thiosulfate are present in the solution.

In this case, an exposed high contrast photographic element is developed and then fixed with the fixing solution without using a specific oxidizing bath, which may be used in the process while one step is increased.

The organic acid capable of forming the complex salt with ferric ion is disclosed in U.S. Pat. No. 3,582,322, British Pat. No. 739,202, German Pat. No. 866,605, etc.

Thus, fringes are sufficiently removed. In accordance with the process, therefore, an improvement of dot-images in comparison with dot-etching by the Farmer's reducer can be accomplished only by carrying out a simple processing substantially similar to the ordinary processing of development and fixing.

Since, in any method, the solution of oxidizing agent is sufficiently stable and has a reproducible and constant effect of removing fringes, the instant invention is favorably compared with the prior dot-etching method using the Farmer's reducer in storage of solution, ease of operation, operation efficiency and consumption of solution.

A developer to be used in the invention may be the conventional lithographic developers. That is to say, the developer contains hydroquinone as a developing agent, a sulfite and an alkali.

Developing agents used in the invention are dihydroxybenzenes such as hydroquinone, chlorohydroquinone, bromohydroquinone, isopropylhydroquinone, toluhydroquinone, methylhydroquinone, 2,3-dichlorohydroquinone, 2,5-dimethylhydroquinone, etc., which are disclosed in U.S. Pat. No. 3,573,914.

A suitable amount of the developing agent is 5 to 50 g, preferable 10 to 30 g, per 1 liter of developer.

Sulfite may be contained so that a low concentration of free sulfite ion, is present in the amount of 5 g or less, especially 1 to 3 g, per 1 liter of the developer. Sulfite may be added as a sulfite compound such as sodium sulfite, or may be added as an adduct. These compounds are usually used as a mixture of sulfite and the adduct. In this case, it has been considered that adduct acts as a sulfite ion buffer.

As the examples of the adducts are an aldehyde-alkali bisulfite adduct such as p-formaldehyde-sodium bisulfite adduct, a ketone-alkali bisulfite adduct such as acetone-sodium bisulfite adduct, and a carbonyl bisulfite-amine condensation product such as sodium-2-hydroxyethylaminomethane sulfonate, etc.

These products can be easily selected in the art such as British Pat. No. 928,390 or U.S. Pat. No. 3,573,914.

In the developer, a conventional preservative such as ascorbic acid or kojic acid may be added.

The alkali is added so that pH of the developer is maintained in the alkali side, especially pH 8, or more, and more preferably pH 9–11. Accordingly, the amount and kind of the alkali are not limited so long as the above pH is maintained.

To the developer, any other additives such as an antifoggant, e.g., potassium bromide or 1-phenyl-5-mercoptotetrazole, can be incorporated.

An oxidizing bath to be used after the development contains an oxidizing agent and a halide compound, and optionally acids and alkalis for pH adjusting, salts having a buffering action and salts for raising the ionic strength. As the oxidizing agent are used bichromates such as sodium and potassium bichromates, ferricyanide, persulfates such as sodium and ammonium persulfates, and perchlorates such as sodium and potassium perchlorates, and as the halide compound are used chlorides, bromides and iodides of sodium, potassium and ammonium. In addition, acids such as acetic acid, hydrochloric acid or nitric acid and salts such as sodium acetate or potassium hydrogen phosphate may be added. The time for the oxidizing bath is ordinarily changed between 5 and 100 seconds, depending on the kind of a light-sensitive photographic material and the chemical composition of the solution. Following the oxidizing bath, a light-sensitive material is optionally subjected to rinsing or water-washing and then subjected to ordinary fixing and water washing.

In the case of the other method, on the other hand, a fixing solution to be used following development contains a chelate compound (complex salt) of ferric ion with ethylenediaminetetraacetic acid (EDTA) or nitrilotriacetic acid as the oxidizing agent and ammonium or alkali metal thiosulfate as the fixing agent, to which other additives such as sodium or potassium sulfite, potassium alum, sodium acetate, glacial acetic acid or boric acid may be optionally added. This fixing solution has an ordinary fixing capacity and further decreases fringes of dot-images during fixing. The time for this treatment is similar to that of the ordinary fixing treatment and ordinarily 30–300 seconds, preferably about 60 seconds. The addition amount of the iron chelate compound is 1–50 g, preferably 5–15 g, per 1 liter of the fixing solution.

The method of the invention is apparently similar to the treatment method of a black-and-white reversal film, but different in essence. In the case of the black-and-white film, bleaching and second development are carried out following development. The bleaching solution in this case is a sulfuric acid-acidic solution of potassium bichromate (pH = less than 1) which is much stronger than the bleaching solution of the invention and capable of oxidizing and dissolving completely developed silver. In the case of the oxidizing bath according to the invention, developed silver forming a dot-image remains on a film as it is.

The method of the invention is applicable to treatment of any high contrast photographic element such as lith film or lith dry plate. A silver halide emulsion used for the photographic element may be silver chloride, silver bromide, silver chlorobromide and silver chloroiodobromide.

Preferably, the photographic emulsion contains at least 50 mol % silver chloride, more preferably at least 75 mol %, and the other content of silver iodide, silver bromide or mixture thereof.

The silver halide emulsion layer of the high-contrast photographic elements can contain any hydrophilic water-permeable binder, e.g., gelatin, modified gelatin such as phthalated gelatin, colloidal alubmin, polyvinyl compounds, acrylamide polymers or mixture thereof. The photographic emulsion may contain a water-insoluble polymerized vinyl compound such as polyacrylic acid, polymethacrylic acid, polyalkylacrylate, copolymer thereof or mixture thereof.

The high contrast photographic emulsion is then coated on a support such as glass, paper, cellulose nitrate film, cellulose ester film, polystyrene film, polyethylene terephthalate film or resin-coated paper. Moreover, it can be adapted regardless of spectral sensitization, chemical sensitization and addition of a sensitizer such as polyethylene glycol, a fog inhibitor such as tetraazaindene, a hardener such as mucochloric acid or other additives.

The following examples are given in order to illustrate the invention in detail without limiting the same.

EXAMPLE 1

A high contrast photographic element composed of a support having coated thereon a gelatino-silver chloroiodobromide emulsion (AgCl: 75 mol %, AgI: 0.2 mol %) was subjected to stepwise dot-image exposure through a 133 line magenta contact screen and step wedge for sensitometry and developed by the following two manners.

| | | |
|---|---|---|
| Standard Treatment (prior art) | | |
| Developer I | 20° C | 3 minutes |
| Stopping | " | 15 seconds |
| Fixing solution I | " | 3 minutes |
| Water washing | " | 5 minutes |
| Improved treatment A | | |
| Developer I | 20° C | 3 minutes |
| Stopping | " | 15 seconds |
| Oxidizing solution I | " | 30 seconds |
| Rinse | " | 30 seconds |
| Fixing solution I | " | 3 minutes |
| Water washing | " | 5 minutes |

The compositions of the treating solutions are as follows:

| | |
|---|---|
| Developer I | |
| Water | 500 ml |
| Sodium sulfite | 30 g |
| Paraformaldehyde | 7.5 g |
| Potassium metabisulfite | 2.6 g |
| Boric acid | 7.5 g |

-continued

| | |
|---|---|
| Hydroquinone | 22.5 g |
| Potassium bromide | 1.6 g |
| Water to 1000 ml | |
| Stopping solution | |
| 1.5 % Aqueous solution of glacial acetic acid | |
| Fixing solution I | |
| Sodium thiosulfate | 200 g |
| Sodium sulfite | 15 g |
| Sodium acetate | 10 g |
| Glacial acetic acid | 20 ml |
| Potassium alum | 15 g |
| Water to 1000 ml | |
| Oxidizing solution I | |
| Potassium bichromate | 20 g |
| 3% Aqueous hydrochloric acid | 50 ml |
| Water to 1000 ml | |

The dot-image samples treated by the foregoing two methods were traced by means of a microdensitrometer to measure the extension of a fringe around dot. As shown in Table 1, the method B of the invention gave a smaller extension of fringe than the standard method of the prior art. In this table, "Dot-image area ratio" means a ratio of a blackened area of dot-image to a sample area and "Extension of fringe" means a value obtained by subtracting from the size (diameter) of a dot at a traced image density of 3 the size at a density of 2.5.

Table 1

| | Standard treatment | | Improved treatment A | |
|---|---|---|---|---|
| Dot-image area ratio | 20% | 50% | 20% | 40% |
| Extension of fringe | 28μ | 30μ | 20μ | 25μ |

EXAMPLE 2

A high contrast photographic element same as in Example 1 was exposed similar to Example 1 and subjected to the following treatment:

Standard treatment

Same as Example 1

Improved treatment B

Oxidizing solution I in Improved treatment A was substituted by the following Oxidizing solution II.

| | |
|---|---|
| Oxidizing solution II | |
| Potassium bichromate | 20 g |
| Sodium chloride | 30 g |
| Glacial acetic acid | 30 ml |
| Water to 1000 ml | |

Improved treatment C

In Improved treatment B, the bleaching time was extended to 90 seconds.

Improved treatment D

Oxidizing solution in Improved treatment A was substituted by the following Oxidizing solution III.

| | |
|---|---|
| Oxidizing solution III | |
| Potassium ferricyanide | 20 g |
| Potassium bromide | 15 g |
| Water to 1000 ml | |

Improved treatment E

Oxidizing solution I in Improved treatment A was substituted by the following Oxidizing solution IV.

| | |
|---|---|
| Oxidizing solution IV | |
| Potassium ferricyanide | 35 g |
| Sodium chloride | 65 g |

-continued

| | |
|---|---|
| Water to 1000 ml | |

Improved treatment F

In Improved treatment E, the bleaching time was extended to 60 seconds.

Improved Treatment G

Oxidizing solution in Improved treatment A was substituted by the following Oxidizing solution V.

| | |
|---|---|
| Oxidizing solution V | |
| Potassium ferricyanide | 35 g |
| Sodium chloride | 60 g |
| Glacial acetic acid | 60 ml |
| Water to 1000 ml | |

As shown in Table 2, the method of the invention is favourable compared with the prior art method in that the extension of fringe is markedly reduced.

Table 2

| Treatment method | | Extension of fringe at a dot area ratio of 50% |
|---|---|---|
| Standard (prior art) | | 30 μ |
| Improved treatment | B | 20 " |
| " | C | 18 " |
| " | D | 18 " |
| " | E | 20 " |
| " | F | 16 " |
| " | G | 14 " |

EXAMPLE 3

Photographic films were prepared by applying silver chloride, silver bromide and silver chlorobromide (silver chloride 70 mol %) gelatin emulsions, respectively, to a cellulose acetate film, subjected to dot-image photographing similar to that of Example 1 and then subjected to the following standard treatment and improved treatment:

| | | |
|---|---|---|
| Standard treatment | | |
| Developer II | 20° C | 165 seconds |
| Rinse | " | 4 seconds |
| Fixing solution I | " | 120 seconds |
| Water washing | " | 5 minutes |
| Improved treatment | | |
| Developer II | 20° C | 165 seconds |
| Oxidizing bath V | " | 30 seconds |
| Fixing solution I | " | 120 seconds |
| Water washing | " | 5 minutes |
| Developer II | | |
| Hydroquinone | | 20 g |
| Sodium sulfite | | 2 g |
| Adduct of formaldehyde and sodium bisulfite | | 50 g |
| Sodium carbonate monohydrate | | 80 g |
| Boric acid | | 7 g |
| Potassium bromide | | 2 g |
| Water to 1000 ml | | |

As shown in Table 3, the extensions of fringe of all the samples were decreased by the method of the invention.

Table 3

| Sample | Extension of fringe at a dot area ratio of 50% | |
|---|---|---|
| | Standard treatment | Improved treatment |
| silver chloride emulsion | 28 μ | 24 μ |
| silver bromide emulsion | 35 μ | 28 μ |
| silver chlorobromide | | |

Table 3-continued

| Sample | Extension of fringe at a dot area ratio of 50% | |
|---|---|---|
| | Standard treatment | Improved treatment |
| emulsion | 23 μ | 16 μ |

EXAMPLE 4

A photographic film as in Example 1 was subjected to stepwise dot-image exposure through a 133 line magenta contact screen and step wedge for sensitometry and then to the following standard treatment and improved treatment:

Improved treatment J

Fixing solution I in Standard treatment of Example 1 was substituted by Fixing solution II.

Improved treatment K

In Improved treatment J, the fixing time was 180 seconds.

Improved treatment L

Fixing solution II of Improved treatment J was substituted by Fixing solution III.

Improved treatment M

In Improved treatment L, the fixing time was changed to 180 seconds.

Fixing solution II 10 g of $Fe^{III}$-EDTA complex salt was added to 1000 ml of Fixing solution I.

Fixing solution III 10 g of $Fe^{III\text{-}NTA}$ (nitrilotriacetate) complex salt was added to 1000 ml of Fixing solution I.

As shown in Table 4, improvements are apparent and red fringes around dots are removed.

Table 4

| Treatment | 20% | 50% |
|---|---|---|
| Standard treatment | 28 μ | 30 μ |
| Improved treatment J | 27 μ | 28 μ |
| Improved treatment K | 24 μ | 26 μ |
| Improved treatment L | 27 μ | 29 μ |
| Improved treatment M | 24 μ | 26 μ |

EXAMPLE 5

Three kinds of silver halide emulsions used in Example 3 were exposed in the similar manner to Example 3 and subjected to Improved treatment K to thus obtain the following results:

Table 5

| Sample | Extension of fringe at a dot area ratio of 50% | |
|---|---|---|
| | Standard treatment | Improved treatment K |
| silver chloride emulsion | 29 μ | 27 μ |
| silver bromide emulsion | 37 μ | 32 μ |
| silver chlorobromide emulsion | 25 μ | 22 μ |

What is claimed is:

1. A method for forming a high-contrast silver halide photographic image, which comprises developing an exposed high-contrast silver halide photographic element containing at least 50 mol percent silver chloride with a developer containing:
   (1) at least one dihydroxybenzene compound, and
   (2) a sulfite ion, said sulfite ion being present in a concentration of 5 grams or less per liter of said developer, fixing said photographic element after developing and before or during fixation treating said developed photographic element with a solution containing a halide and an oxidizing agent selected from the group consisting of a bichromate, a ferricyanide, a persulfate and a perchlorate, or a solution containing a ferric ion chelate complex salt oxidizing agent.

2. The method as claimed in claim 1 wherein said solution is an oxidizing bath which is used before fixation.

3. The method as claimed in claim 1 wherein said solution is a fixing bath.

4. The method as claimed in claim 1 wherein said developer further contains a sulfite ion buffer.

5. The method as claimed in claim 4 wherein said developer further contains an aldehyde-bisulfite adduct.

6. The method as claimed in claim 4 wherein said developer further contains ketone-bisulfite adduct.

7. The method of claim 1, wherein said silver chloride concentration is at least 75 mol percent.

8. The method of claim 1, wherein said sulfite ion concentration ranges from 1 to 3 grams per liter of developer.

9. A method for forming a high-contrast silver halide photographic image which comprises developing an exposed high-contrast silver halide photographic element containing at least 50 mol percent silver chloride with a lithographic developer containing:
   (1) hydroquinone,
   (2) a sulfite ion, said sulfite ion being present in a concentration of 5 grams or less per liter of said developer and
   (3) a sulfite ion buffer,
   subsequently treating said photographic element with an oxidizing bath containing an oxidizing agent selected from the group consisting of a bichromate, a ferricyanide, a persulfate and a perchlorate and a halide and then
   fixing said photographic element.

10. The method as claimed in claim 9 wherein said halide is an alkali halide a ammonium halide.

11. The method of claim 9, wherein said silver chloride concentration is at least 75 mol percent.

12. The method of claim 9, wherein said sulfite ion concentration ranges from 1 to 3 grams per liter of developer.

13. A method for forming a high-contrast silver halide photographic image which comprises developing an exposed high-contrast silver halide photographic element containing at least 50 mol percent of silver chloride with a lithographic developer containing:
   (1) hydroquinone,
   (2) a sulfite ion, said sulfite ion being present in an amount of 5 grams or less per liter of developer, and
   (3) a sulfite ion buffer, and
   subsequently treating said photographic element with a fixing solution containing a fixing agent, and an oxidizing agent which consists of a chelate complex salt of a ferric ion with an organic acid.

14. The method as claimed in claim 13 wherein said complex salt is sodium ferric ethylenediamine tetraacetic acid.

15. The method as claimed in claim 13 wherein said fixing agent is an alkali metal thiosulfate or an ammonium thiosulfate.

16. The method of claim 13, wherein said silver chloride concentration is at least 75 mol percent.

17. The method of claim 13, wherein said sulfite ion concentration ranges from 1 to 3 grams per liter of developer.

18. A two-step method for forming a high-contrast silverhalide photographic image, which comprises developing an exposed high contrast silver halide element with an infectious developer containing hydroquinone and sulfite ion and thereafter fixing said developed element with a solution containing a ferric ion chelate complex salt oxidizing agent annd a thiosulfate fixing agent.

* * * * *

UNITED STATES PATENT OFFICE

CERTIFICATE OF CORRECTION

Patent No. 4,113,489 Dated Sept. 12, 1978

Inventor(s) Mitsunori Sugiyama et al.

It is certified that error appears in the above-identified patent and that said Letters Patent are hereby corrected as shown below:

The term of this patent subsequent to October 2, 1990 has been disclaimed.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*